United States Patent [19]

Barradas

[11] Patent Number: 5,046,516

[45] Date of Patent: Sep. 10, 1991

[54] HAIR CURLING IRON

[76] Inventor: George Barradas, 15 Riverview Ct., Glenville, Conn. 06830

[21] Appl. No.: 264,856

[22] Filed: Oct. 31, 1988

[51] Int. Cl.[5] ..... A45D 1/04

[52] U.S. Cl. ..... 132/232; 219/222; 219/225

[58] Field of Search ..... 132/227, 228, 229, 231, 132/232; 219/222, 225

[56] References Cited

U.S. PATENT DOCUMENTS

| | | | |
|---|---|---|---|
| 1,924,939 | 8/1933 | McCandless | 132/232 |
| 3,935,423 | 1/1976 | Pucci | 132/232 |
| 3,955,064 | 5/1976 | Demetrio et al. | 132/232 |
| 4,032,747 | 6/1977 | Kunz | 219/222 |
| 4,121,602 | 10/1978 | Young | 132/113 |
| 4,163,143 | 7/1979 | Federico et al. | 132/232 |
| 4,215,264 | 7/1980 | Hetherington | 132/232 |
| 4,227,541 | 10/1980 | Satchell | 132/232 |
| 4,242,567 | 2/1980 | Carter | 219/225 |
| 4,267,851 | 5/1981 | Plaisted | 132/229 |
| 4,426,567 | 1/1984 | Gugliotti | 132/232 |
| 4,496,825 | 1/1985 | Andis | 132/232 |
| 4,503,317 | 3/1985 | Mancillas | 132/232 |
| 4,533,819 | 8/1985 | Valiulis | 132/232 |
| 4,549,560 | 10/1985 | Andis | 132/232 |
| 4,581,519 | 4/1986 | Thaler et al. | 132/232 |
| 4,625,738 | 12/1986 | Skovdal et al. | 132/229 |
| 4,695,704 | 9/1987 | Andis | 132/232 |
| 4,797,533 | 1/1989 | Santhouse et al. | 219/225 |
| 4,849,593 | 7/1989 | Hughes et al. | 132/229 |

FOREIGN PATENT DOCUMENTS

| | | | |
|---|---|---|---|
| 0021941 | 1/1981 | European Pat. Off. | 219/225 |
| 2615267 | 10/1977 | Fed. Rep. of Germany | 132/232 |
| 0738128 | 12/1932 | France | 132/229 |
| 2123286 | 2/1984 | United Kingdom | 219/225 |

*Primary Examiner*—John J. Wilson
*Assistant Examiner*—Frank A. LaViola, Jr.
*Attorney, Agent, or Firm*—Alfred E. Miller

[57] ABSTRACT

A hair curling iron in which at least the heating metal portion, such as the iron part, is covered with a resilient material whereby the hair ends are cushioned between the hair clamp and the rigid heating part to thus avoid, or reduce, the possibility of breaking the hair ends when curling the hair. The curling iron has a variety of shapes so that different curl configurations can be effected.

4 Claims, 10 Drawing Sheets

FIG.1
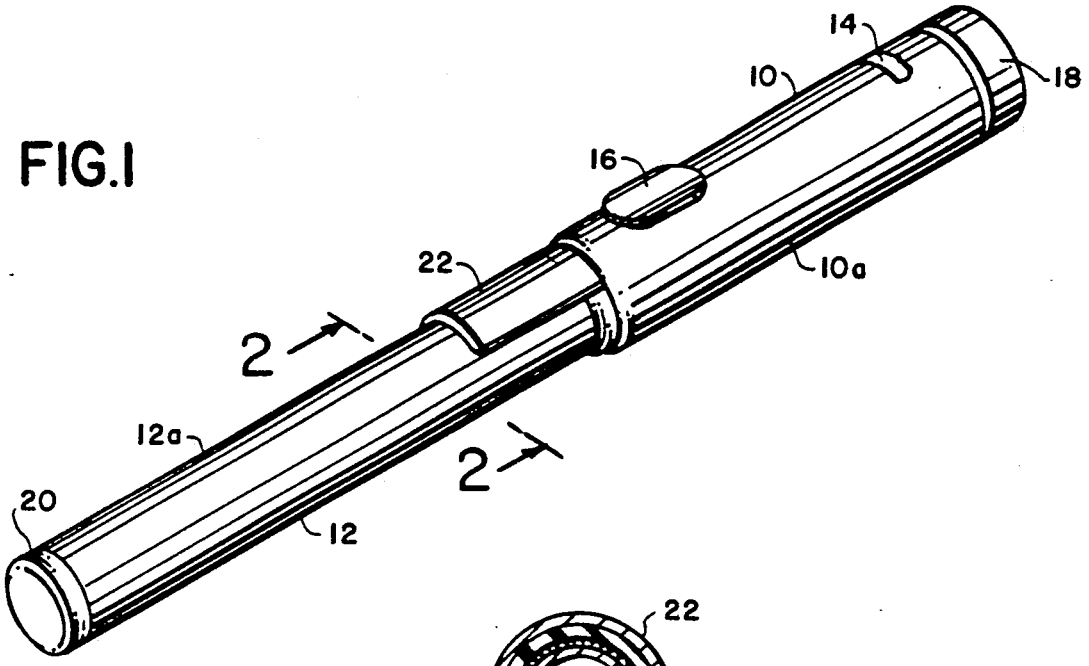
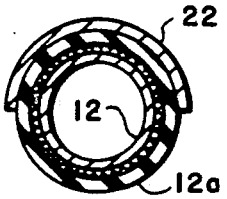
FIG.2
FIG.3
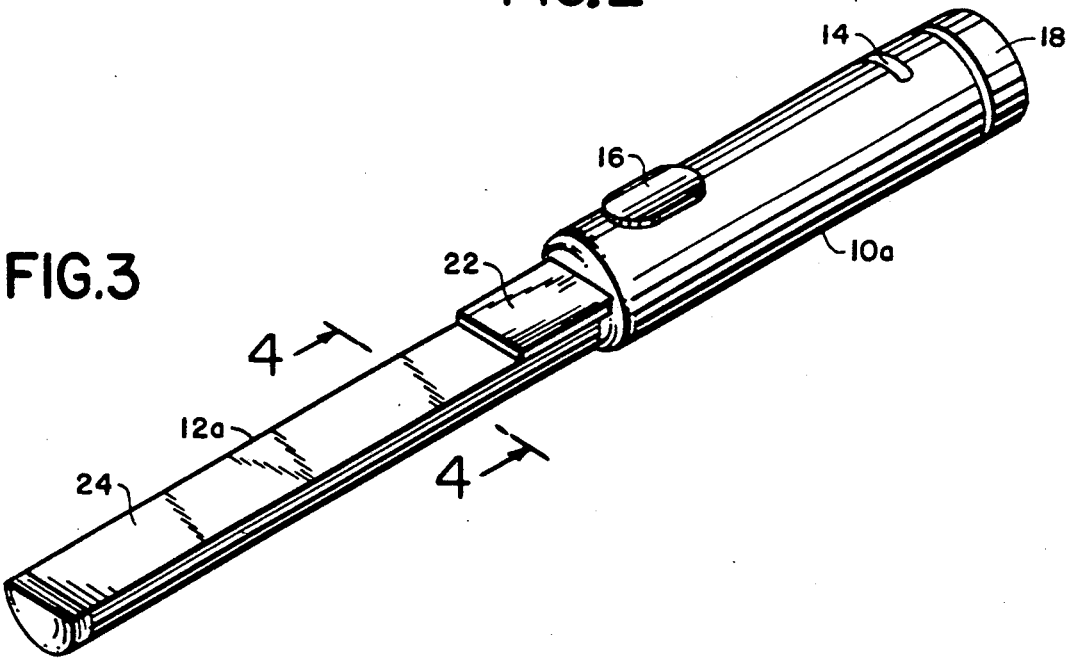
FIG.4
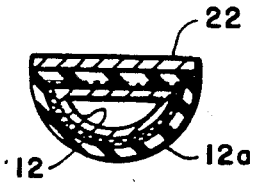

FIG.13
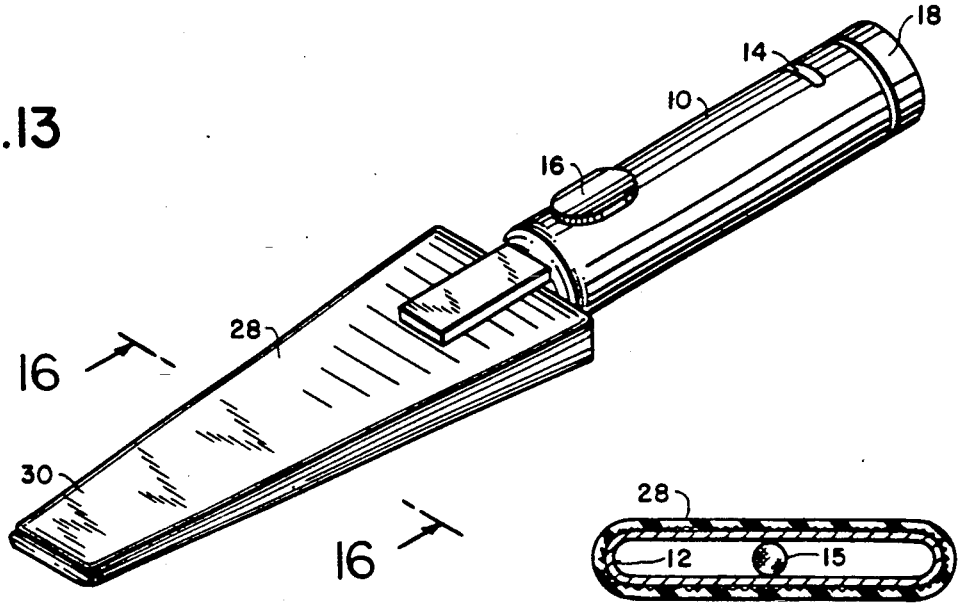
FIG.16
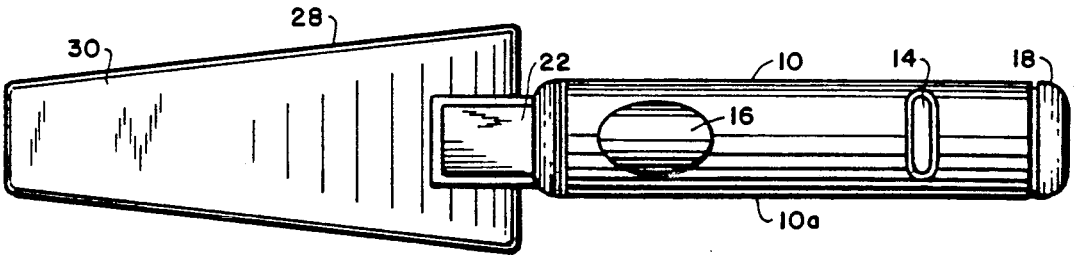
FIG.14
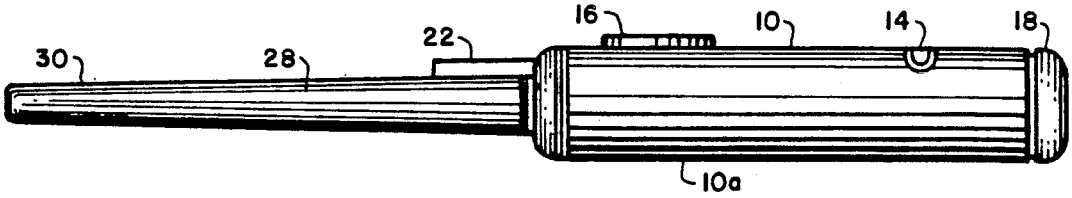
FIG.15

HAIR CURLING IRON

The present invention relates to a curling iron to curl hair in different shapes and different configurations.

It is a principal object of the present invention to provide a rigid curling iron in which the outer surfaces are covered with yieldable material, and this includes not only the handle but the heated portion of the iron. The use of heat transmitting flexible material for the heated portion of the curling iron has a desirable hair treatment result that the hair ends will not break when making curls due to the softness of the heated portion about which the hair ends are curled. The heated curling irons of the currently known and used type are hard, and the rigid metal surfaces which, when heated and functioning, tend to break the hair ends of the user.

It is an object of the present invention to provide a curling iron having a silicone covering for both the handle portion and the heating iron portion so that different types and sizes of curl can be made at the option of the user.

It is another object of the present invention to provide a soft surface curling iron which is simple and inexpensive to fabricate yet is very effective for providing the user with a variety of curl types. Any suitable type of heater device can be used in the present invention, such as a known rope heater or a PTC.

In order that the present invention will be more clearly understood, it will now be disclosed in greater detail with reference to the accompanying drawings in which:

FIG. 1 is a perspective view of my novel hair curling device utilizing a soft material on both the handle and heater portion thereof.

FIG. 2 is a view taken along the lines 2—2 of FIG. 1.

FIG. 3 is a perspective view of an alternate embodiment of the invention shown in FIG. 1, in which the heating iron portion is in the form of a hemisphere.

FIG. 4 is a view taken along the lines 4—4 of FIG. 3.

FIG. 13 is a perspective view of another embodiment of the present invention in which the heating iron portion is spade shaped.

FIG. 14 is a top plan view of FIG. 13.

FIG. 15 is a side elevational view thereof.

FIG. 16 is a view taken along the lines 16—16 of FIG. 13.

FIG. 21 is a top plan view with part thereof broken away to show the heating wire there in.

Figure 5:
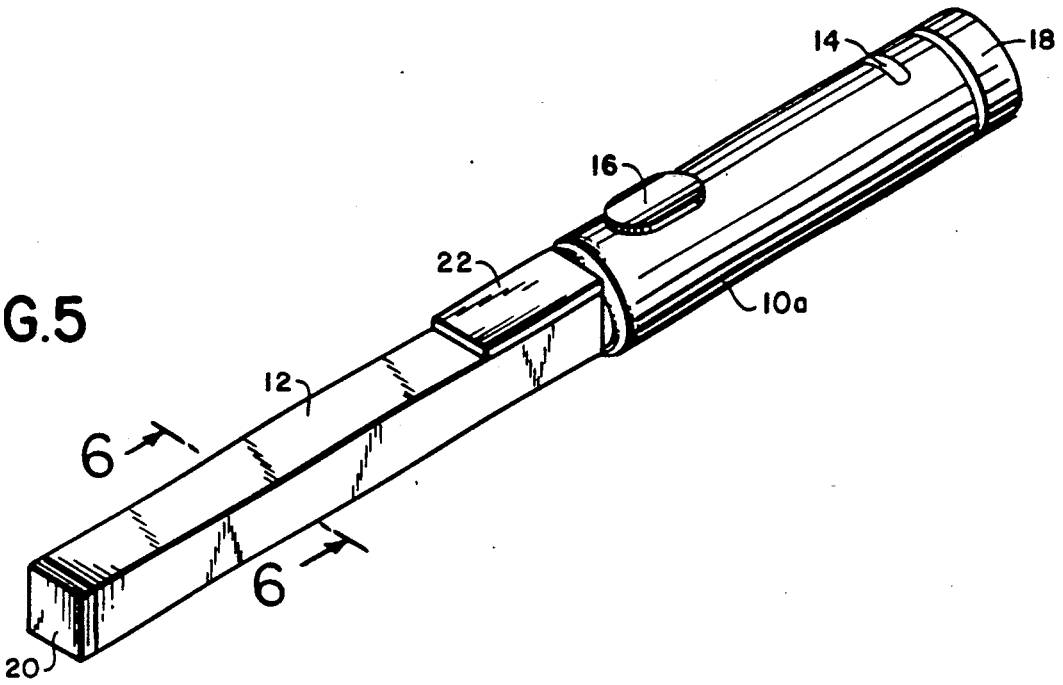
FIG. 5 is another perspective view of a further embodiment of the present invention in which the heating iron portion has a square configuration.
Figure 33:
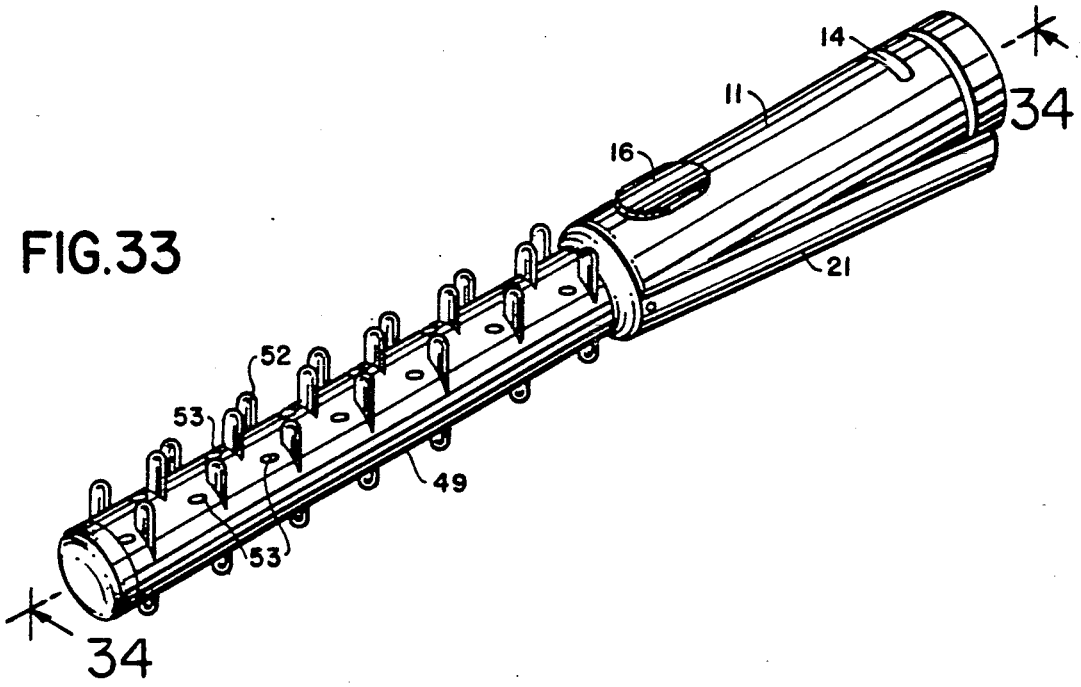
FIG. 33 is an alternate construction similar to curling iron shown in FIG. 26, having in addition a liquid hair treatment capsule in the handle.
Figure 34:
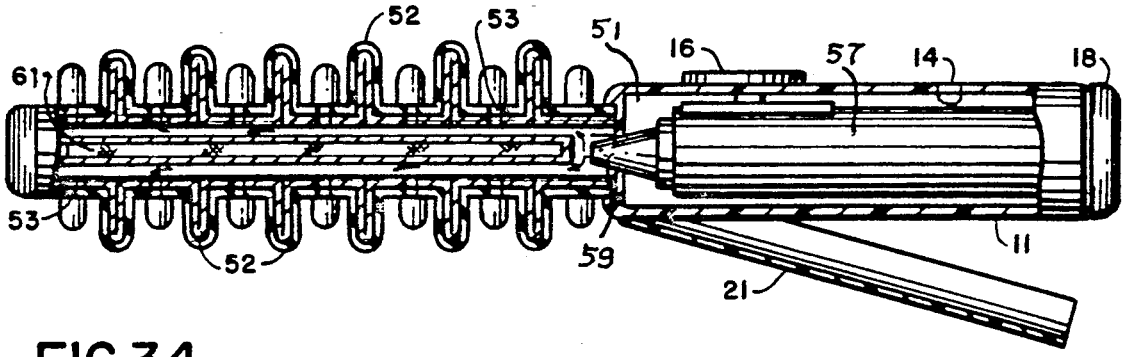
Figure 35:
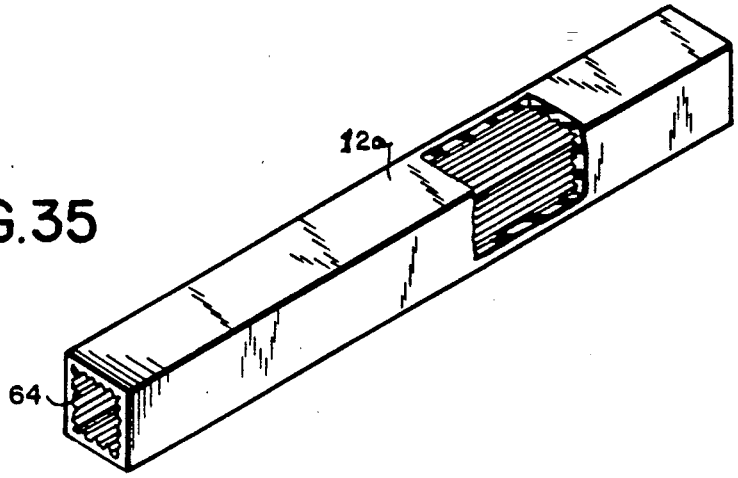

FIG. 34 sectional view, partly in elevation, of the structure shown in FIG. 33, and FIG. 35 is a perspective of the silicone covering of the curling iron shown in FIG. 5.

Referring to the drawings, the hair curling iron shown in FIGS. 1 and 2 is provided with a handle portion 10 of generally cylindrical shape having a heated curling iron part 12. The handle is preferably provided with a indicator light 14 and an actuating button 16. The extreme end of the handle may be provided with an insulated end piece 18 preferably of a thermoplastic material, while the extreme free end of the heating iron part of the curling iron 12 may also be an insulating end piece 20. The actuating button 16 is mechanically connected to a hair clamp 22 at the junction of the handle and the heating iron part. Thus, when the button 16 is depressed, the clamp 22 is elevated in order to permit the hair ends to be inserted between the heating iron and the clamp, or in order to remove the hair ends therefrom. It should be noted that the clamp 22 is curvilinear and is correspondingly shaped to the adjacent cylindrical shaft of the heating iron.

It should be apparent that both the handle 10 and the heatable curling iron 12 are provided with a resilient covering **10*a* and 12*a*** respectively. The covering may take the form of a sleeve of silicone material, which is yieldable, or any other flexible material which provides a cushioning of the hair ends between the clamp and the heating iron, as well as on the rest of the heating iron, as it is curled around the same.

The interior of the silicone covering, as particularly seen in FIG. 35, is ribbed, so that additional resiliency is imparted to the covering inasmuch as the covering is pressed by the curls of the hair against the rigid interior metal heated insert. The interior metal insert is preferably a two part metal shell. This construction provide a better heat conductivity and uniform heat distribution. The soft silicone covering is fabricated as insulation for the metal shell even for old shaped curling iron constructions. Consequently, there is very little likelihood that the user's hair ends will break upon curling around the iron in various forms and configurations, as will be explained hereinafter. It should be apparent that a person curling her hair will not run the risk of the hair ends breaking since the rigid curling iron is covered by a heat-transmitting, flexible material. The internal heater can be either a rope, mica or a PTC heater, within the scope of the present invention.

FIGS. 3 and 4 show another embodiment of the present invention, which is similar to that shown in FIGS. 1 and 2, and in which like parts bear like reference numerals. In FIG. 3 the heating iron portion 10 is constructed in a semicircular configuration having a flat top surface, and a curvilinear bottom surface.

Figure 6:
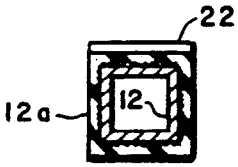
FIG. 6 is a view taken along the lines 6—6 of FIG. 5.
Figure 7:
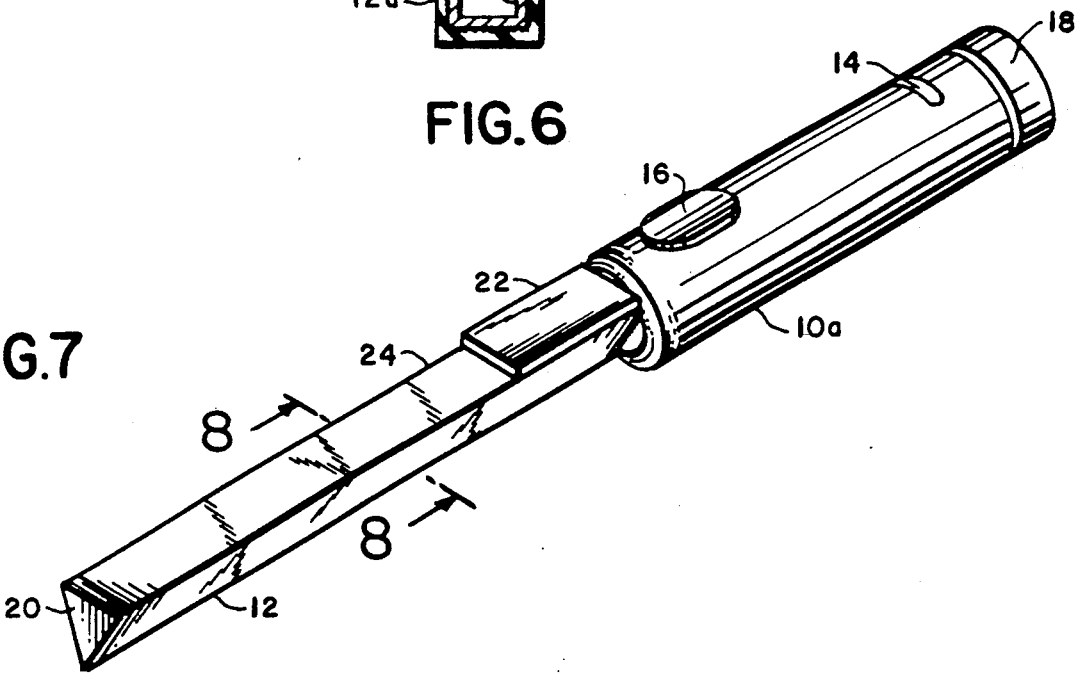
FIG. 7 is another perspective view of an embodiment of the present invention in which heating iron portion is triangular in shape.
Figure 8:
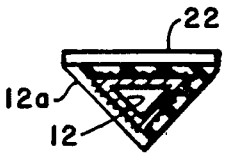
FIG. 8 is a view taken along the lines 8—8 of FIG. 6.
Figure 9:
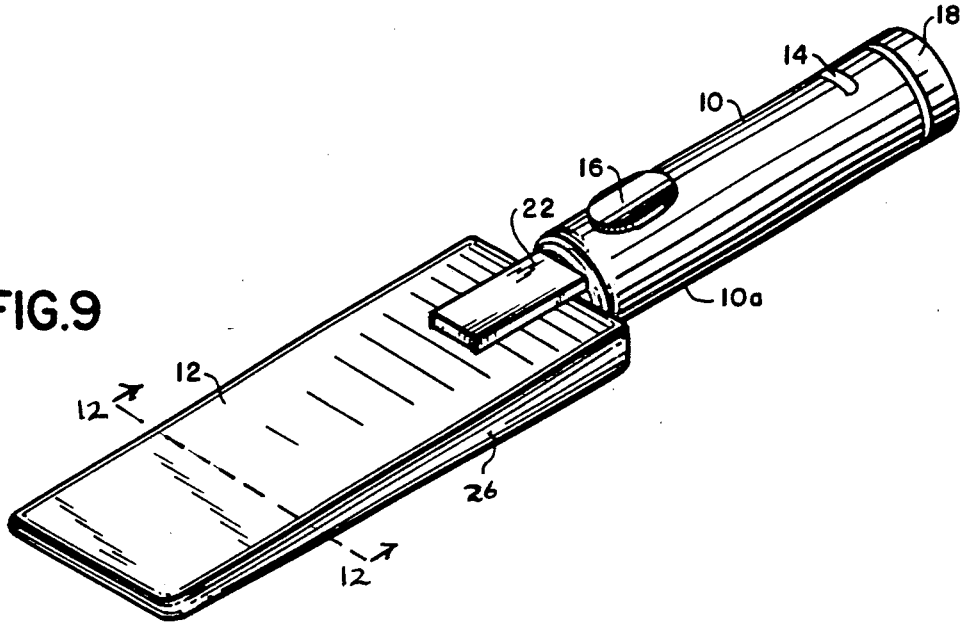
FIG. 9 is a perspective view of a further embodiment of the present invention in which the heating iron portion is paddle-shaped.
Figure 10:
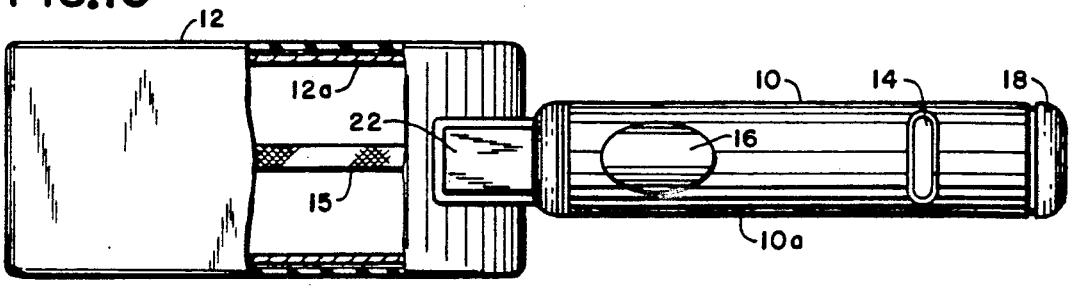
FIG. 10 is a top plan view of FIG. 9 with part of the heating paddle being broken away to show the heating wire therein.
Figure 11:
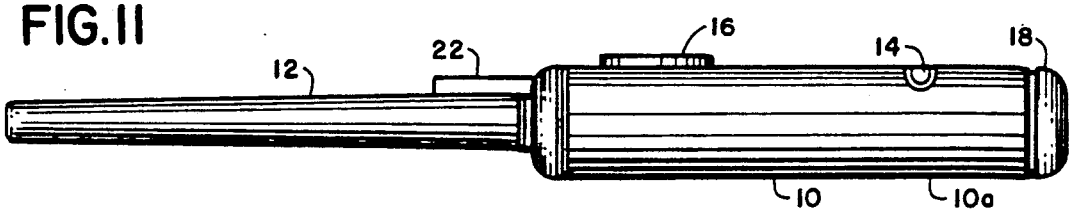
FIG. 11 is a side elevational view of the curling iron shown in FIG. 9.

The clamp 22 is flat and conforms to the flat surface 24 of the heating iron portion. It should be evident that the curl which in this case is not completely round is formed on the curling iron and consequently permits a different configuration of curl for the user. FIGS. 5, 6 and 7 additionally show different configurations for forming curls of the hair ends. In this regard, FIG. 5 shows a square-shaped shaped heating iron part or shell 12 having a silicone covering 12*a* while FIG. 7 shows a triangular-shaped heating iron part 12 also having a silicone covering 12*a*. Both of these alternate embodiments permit the user to have the option of selecting a particular shaped curling iron in order to form correspondingly shaped curls.

Figure 12:
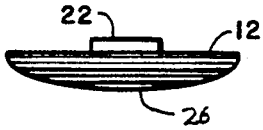
FIG. 12 is a view taken along the lines 12—12 of FIG. 9 showing the bottom surface of the heating panel to be curved.

FIGS. 9–12 show a further embodiment of the present invention in which a handle 10 is similar to the handle shown in FIGS. 1, 3, 5 and 7, however the heating iron part 12 assumes a rectangular flat configuration in which the bottom surface 26 is curved, as seen in FIG. 12. In this construction the user can make larger curls without the risk of breaking the hair ends due to the softness of the silicone covering for the exterior surfaces of the heating iron part 12.

FIGS. 13–16 illustrate another embodiment of the present invention in which the heating iron part 12 is triangular in shape starting from the widest portion 28 adjacent to the handle 10 to the narrowest portion thereof 30 at the extreme end of the heating iron part 12. Consequently, the user can change the diameter of the curl starting at the base which for example can be a 2 inch curl which reduces to a 3¼ of an inch curl at the extreme end 30 of the heating iron part 12 of FIGS. 13–15.

Figure 17:
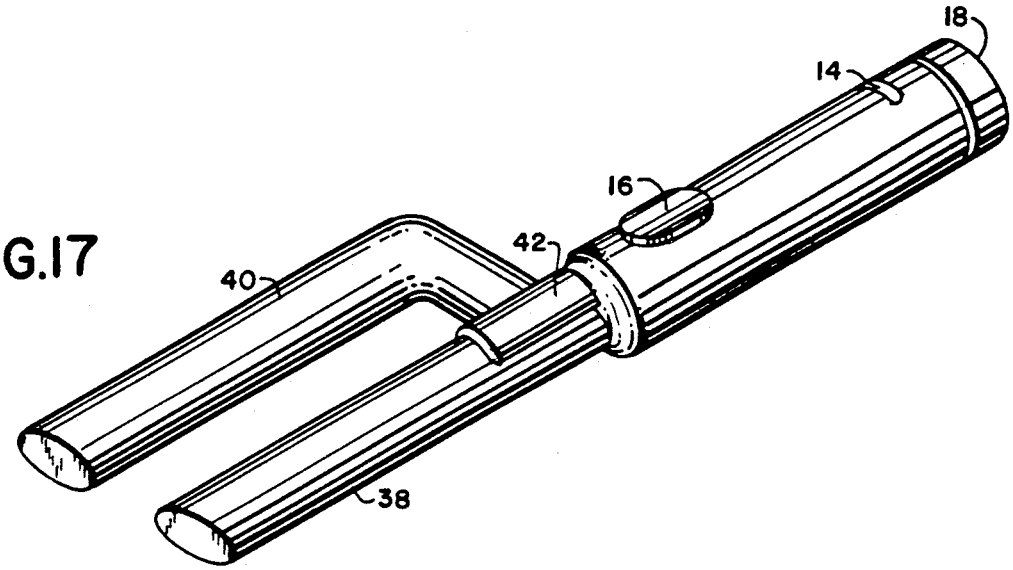
FIG. 17 is a perspective view of a further embodiment of the present invention having two tines.
Figure 18:
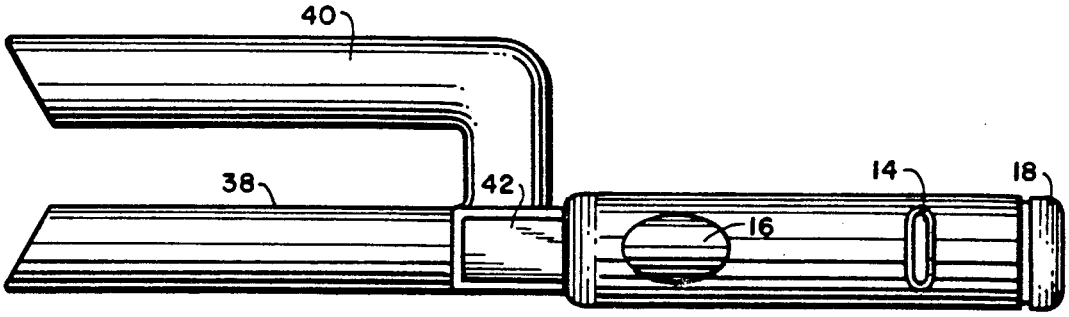
FIG. 18 is a top plan thereof.
Figure 19:
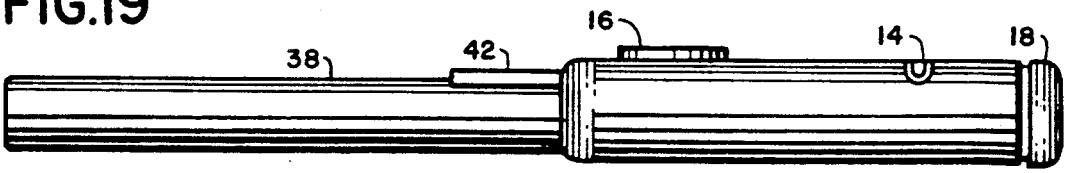
FIG. 19 is a side elevational view thereof.

FIGS. 17–19 illustrate another embodiment of the present invention in which the handle 10 is similar to that shown in FIG. 1 while the heating iron is bifurcated to form a two tine fork having two heating iron portions 38 and 40 together with a clamping device 42 fo the tine 38. It should be apparent that the user of the present curling iron can create different curl configurations on design, for example, a figure eight curl. As in a previous embodiments of the invention, the heating iron portion is covered with a heat transmitting flexible material, such as silicone, to prevent the breaking of hair ends when curls are made on the heating iron.

Figure 20:
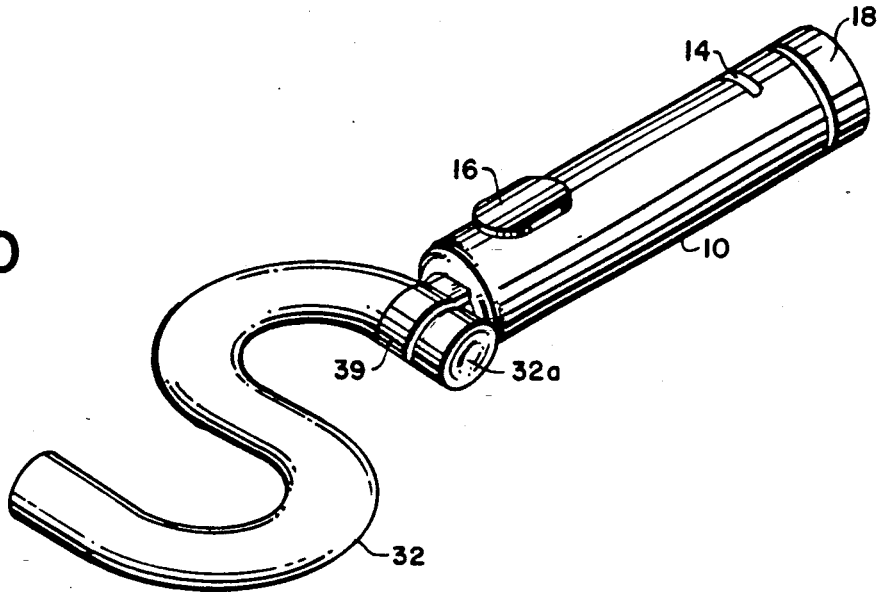
FIG. 20 is a perspective view of a further embodiment of the present invention in which a heating iron portion is S-shaped.
Figure 21:
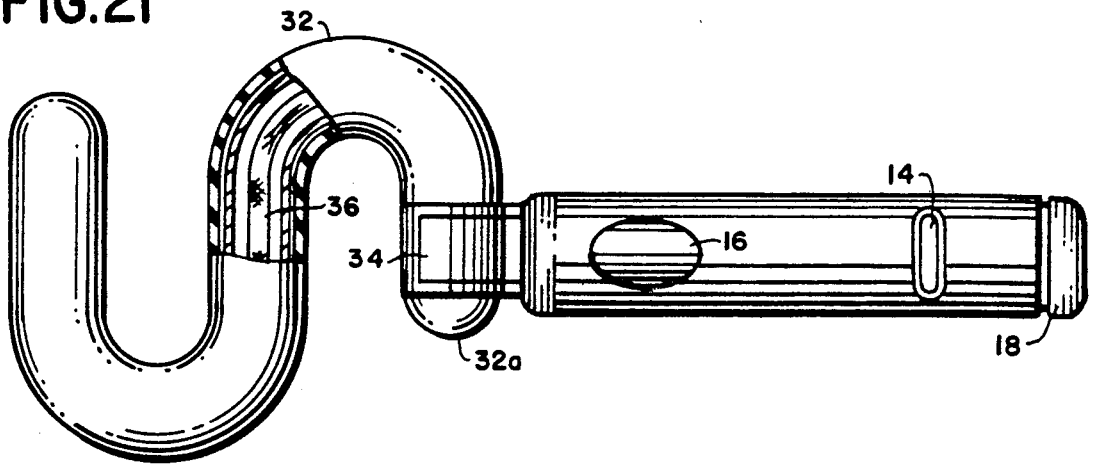
Figure 22:
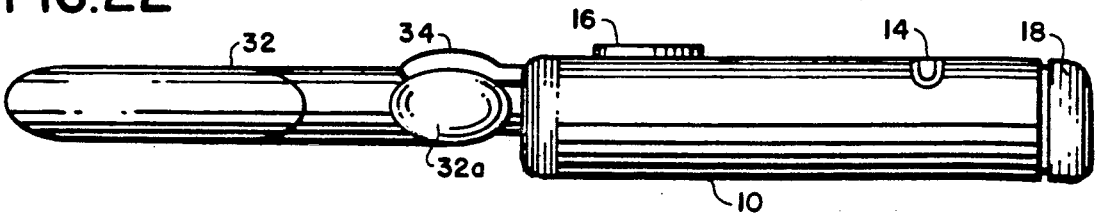
FIG. 22 is a side elevational view thereof.

FIGS. 20–22 show yet another embodiment of the present invention having a handle portion similar to that shown in FIG. 1 but provided with an S-shaped heating iron portion 32 having a curved clamp 34 at the insulated end cap 32*a* of the S-shaped heating iron 32 adjacent to the handle 10. As seen in FIG. 22 a heating element 36 is internally mounted within the heating iron 32.

Figure 23:
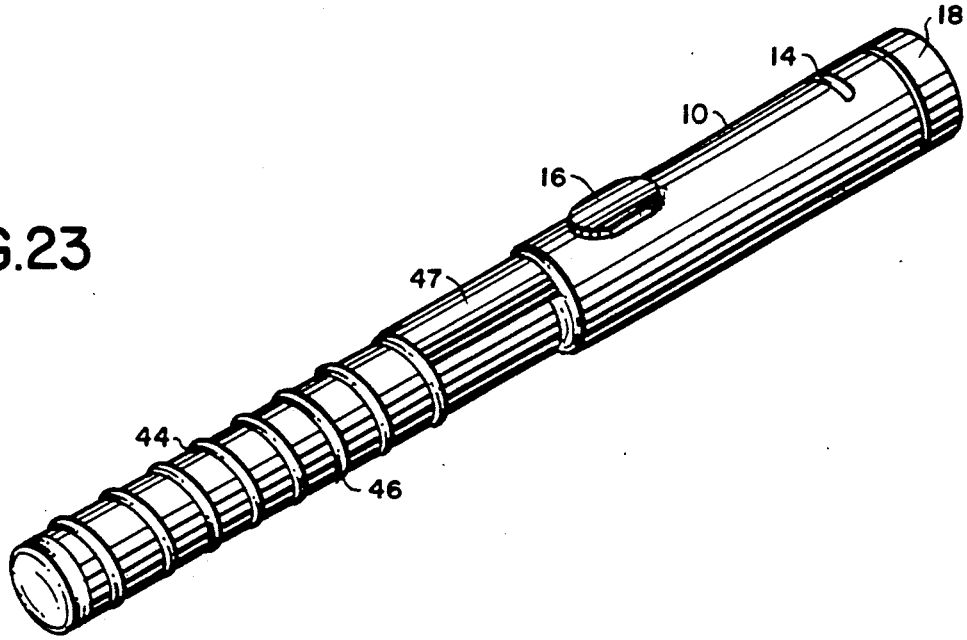
FIG. 23 is a perspective view of another embodiment to the present invention having a helical raised band on the heating iron portion.
Figure 24:
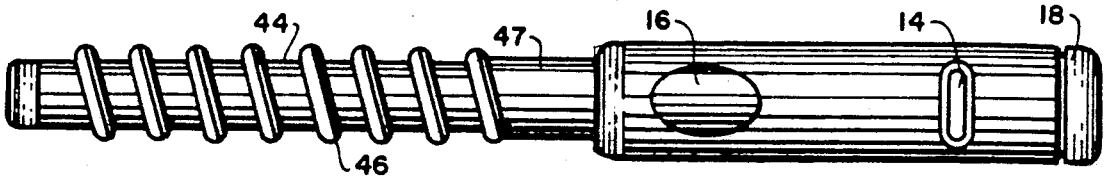
FIG. 24 is a top plan view thereof.
Figure 25:
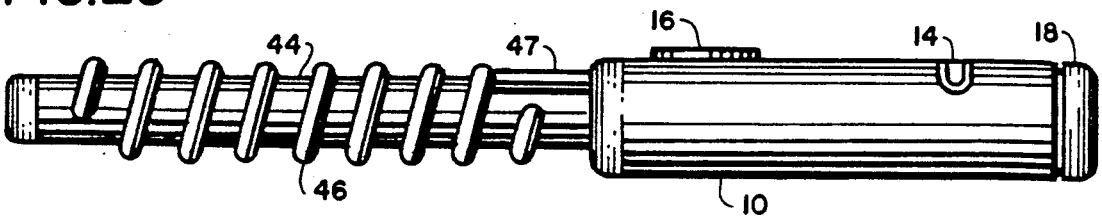
FIG. 25 is a side elevational view thereof.

FIGS. 23–25 show a further embodiment of the present invention in which the heating iron portion 44 of the present invention is a smooth cylindrical, heat-transmitting metal shell and is provided with a silicone covering having helical or spiral bands 46. The flexible silicone has sufficient resiliency so as to prevent the breaking of the hair ends as they are turned around the heating iron barrel 44 to create a series of uniform curls. As in the other embodiments of the present invention this device is provided with the handle portion 10, an indicator light 14, and an actuating button 16. In addition, a hair clamp 47 is shown for clamping of the user's hair.

FIGS. 26–29 shows another arrangement of the present invention in which the barrel-shaped heating portion 48 of the curling iron is provided with metal teeth 50 covered by a resilient covering 52, such as silicone. Consequently, the internal heater within the heating iron portion heats the metal insert support whereby the heat is transferred through the resilient silicone covering to the user's hair.

Figure 28:
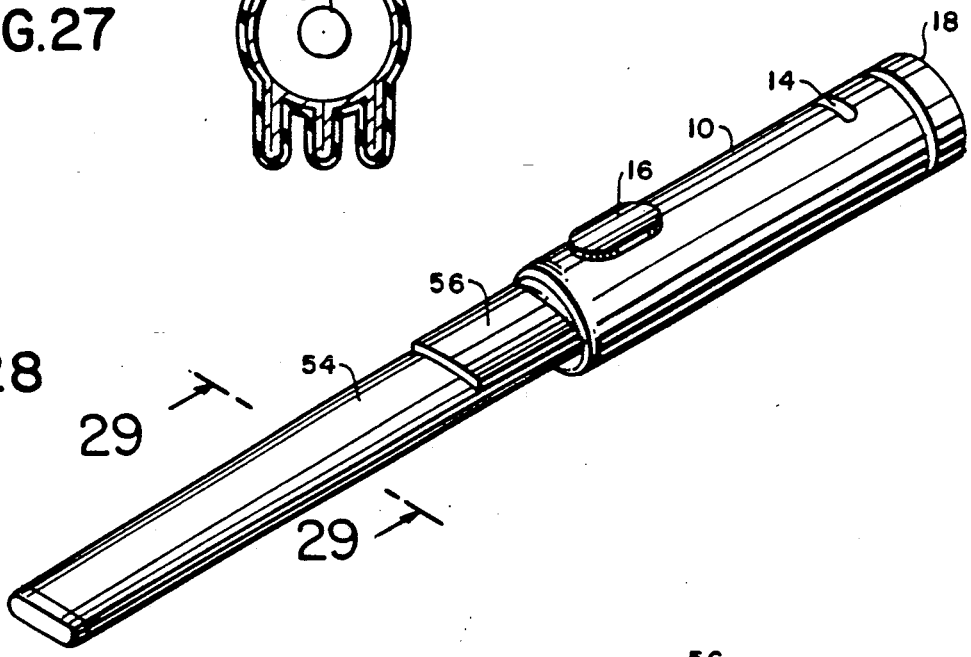
FIG. 28 is a perspective view of a further embodiment of the present invention having a elliptical-shaped heating iron.
Figure 29:
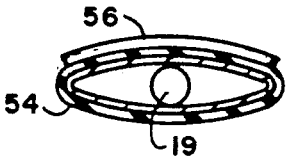
FIG. 29 is a view taken along the lines 29—29 of FIG. 28.

FIGS. 28 and 29 disclose another variation and configuration of the hair curling iron constructed in accordance with the teachings of the present invention in which the heating iron portion 54 is elliptical in shape and is provided with heating iron clamp 56 which conforms to an upper surface of the heating iron, as shown in FIG. 29. This construction also includes a resilient covering for the heating iron portion of the device for the purposes set forth hereinbefore.

Figure 30:
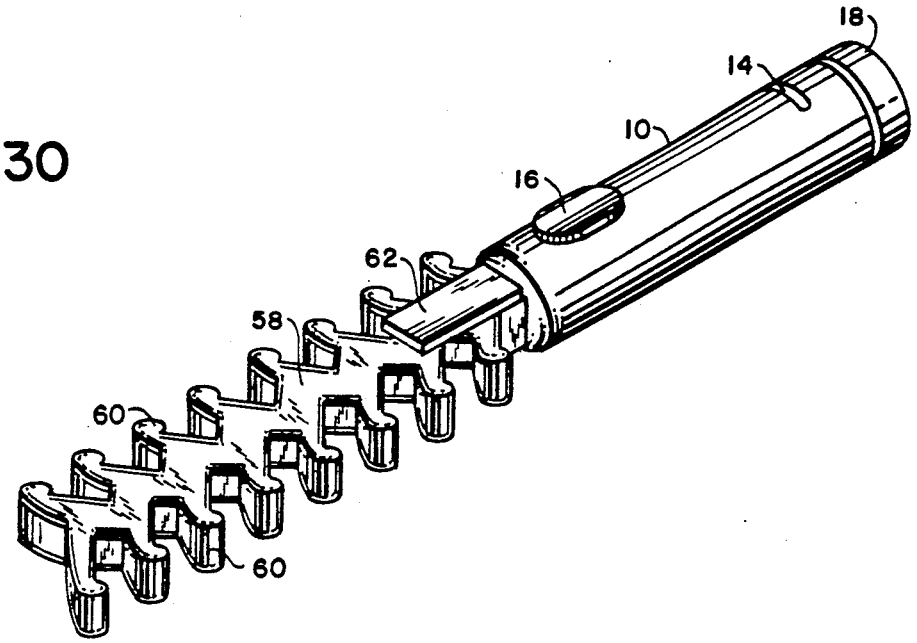
FIG. 30 is a perspective view of a further embodiment of the present invention, in which the heating iron portion is in the form of a zig zag arrangement.
Figure 31:
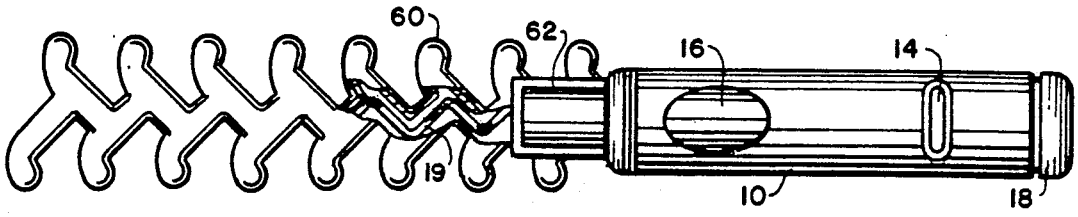
FIG. 31 is a top plan view thereof with part thereof broken away to show the heating wire portion therein.
Figure 32:
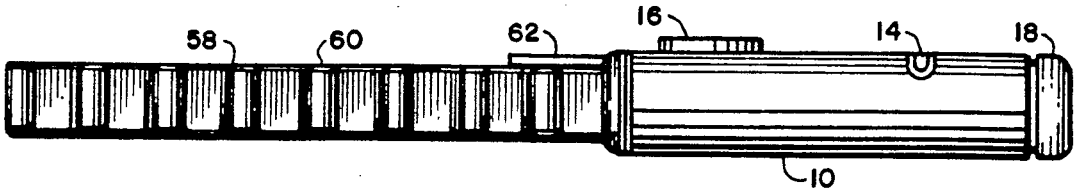
FIG. 32 is a side elevational view thereof.

FIGS. 30–32 illustrate another embodiment of the present invention having a heating iron portion 58 provided with a plurality of wings 60 to form a zig zag arrangement for curling the hair to a specific pattern. In the arrangement shown in FIGS. 30–32 it is preferable to use a rope heater so that uniform heating can be achieved throughout the zig zag arrangement of the heating iron portion 58, as well as the wings 60. Furthermore, in this arrangement, a soft resilient covering is used also for the purposes outlined previously herein.

Figure 26:
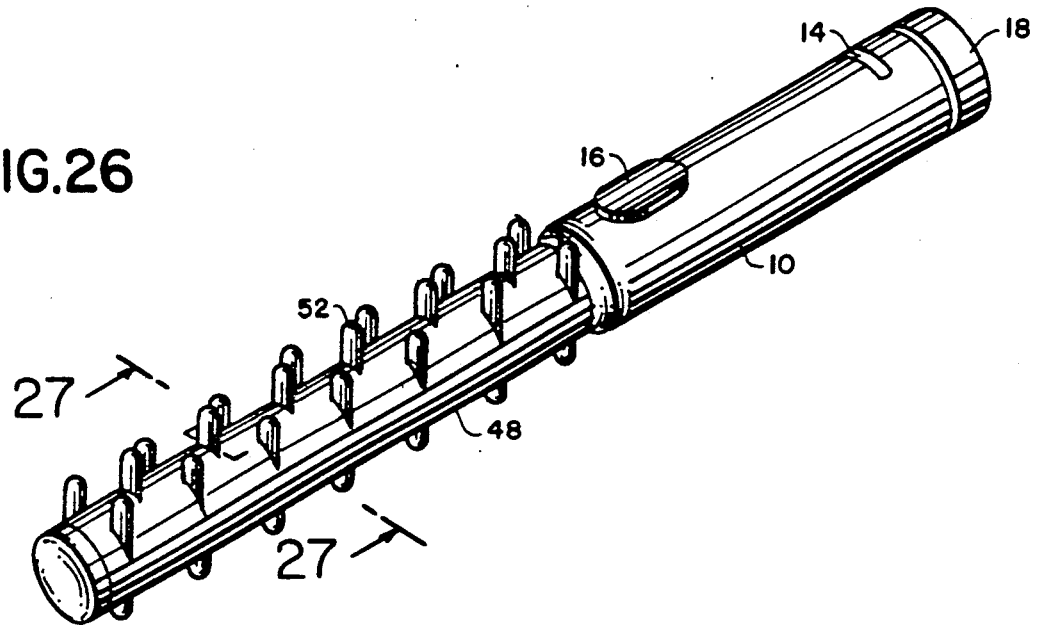
FIG. 26 is still a further perspective view of another embodiment of the invention having comb-like projections.
Figure 27:
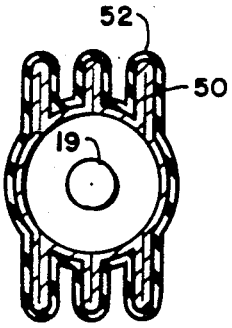
FIG. 27 is a view taken along the lines 27—27 of FIG. 26.

FIGS. 33 and 34 is a further embodiment of the present invention which is similar to construction shown in FIG. 26, however the handle portion 11 is hollow and is provided with a hinged door 21. Within the hollow space 51 is a dispensing tube 57 of hair treatment oil which can be dispensed through opening 59 in the bottom of the hair curling iron 48 and forced out of the spaced holes 53 of the curling iron part 49 for effective hair treatment simultaneously with the curling of the hair. A heating element 61 is mounted above the liquid chamber and is in heat conductive relationship with the metal inner core or shell of the curling iron.

FIG. 35 is an example of the construction of the silicone covering 12*a* for the embodiment of the invention shown in FIG. 5. It should be evident that inner surface 64 is ribbed thus imparting additional resiliency to the covering 12*a*.

While the invention has been disclosed and described herein with reference to certain embodiments of the invention, it is apparent that variations and modifications may be made which will fall within the true spirit and scope of the invention as defined in the following claims:

I claim:

1. A hair curling device comprising a handle having a silicone covering, a heating metal part secured to said handle, a resilient sleeve fabricated of silicone and having a ribbed internal surface fitted over said heating metal part, means for heating said metal part, a clamp mounted on said device for clamping hair between the clamp and said resilient sleeve, and said sleeve having a relatively smooth exterior whereby said hair is cushioned between said clamp and said sleeve when the hair is curled around said sleeve and clamped.

2. A hair curling device comprising a handle having a silicone covering, a hollow cylindrical heat transmitting part being connected to said handle and being provided with a plurality of heat transmitting teeth mounted on the periphery of said cylindrical part and extending substantially perpendicular thereto, said teeth being covered with a resilient silicone covering, and internal heating means for heating said part and said teeth whereby when hair is wound around said cylindrical part heat is transferred through said teeth and the resilient silicone covering to a user's hair.

3. A hair curling device as claimed in claim 2 wherein said hollow heat transmitting part is provided with spaced openings between adjacent heat transmitting teeth whereby a liquid hair treatment substance is directed into said hollow heat transmitting part and thereafter passed through said openings in order to penetrate into the user's hair.

4. A hair curling device as claimed in claim 3 wherein said handle is hollow and is provided with an access door, a dispenser for said liquid treatment substance insertable in said hollow handle, and an opening between said handle and said hollow heat transmitting part for passage of said liquid treatment substance thereto.

* * * * *